US005493828A

United States Patent [19]

Rogowsky et al.

[11] Patent Number: 5,493,828

[45] Date of Patent: Feb. 27, 1996

[54] STRESSING ANCHORAGE FOR PRESTRESSING ELEMENTS IN A PART OF A STRUCTURE

[75] Inventors: David Rogowsky, Belp; Erwin Siegfried, Liebefeld, both of Switzerland

[73] Assignee: VSL International AG, Berne, Switzerland

[21] Appl. No.: 94,004

[22] PCT Filed: Nov. 25, 1992

[86] PCT No.: PCT/CH92/00232

§ 371 Date: Sep. 27, 1993

§ 102(e) Date: Sep. 27, 1993

[87] PCT Pub. No.: WO93/11324

PCT Pub. Date: Jun. 10, 1993

[30] Foreign Application Priority Data

Nov. 26, 1991 [CH] Switzerland ..... 3459/91

[51] Int. Cl.[6] ..... E04C 5/12

[52] U.S. Cl. ..... 52/223.13

[58] Field of Search ..... 52/223.1, 223.13, 52/223.14; 403/370, 371, 367, 368, 374; 24/122.6, 136

[56] References Cited

U.S. PATENT DOCUMENTS

| | | | |
|---|---|---|---|
| 3,524,228 | 8/1970 | Kelly | 52/223.13 |
| 3,605,202 | 9/1971 | Barredo de Valenzuela | 52/223.13 |
| 4,619,088 | 10/1986 | Garcia-Mansilla | 52/223.13 |
| 4,773,198 | 9/1988 | Reinhart | 52/223.13 |
| 4,819,393 | 4/1989 | Augoyard | 52/223.13 |
| 4,837,995 | 6/1989 | Omizono et al. | 52/223.13 |

FOREIGN PATENT DOCUMENTS

| | | |
|---|---|---|
| 1142607 | 9/1957 | France . |
| 2611829 | 9/1988 | France . |
| 965836 | 6/1957 | Germany . |

*Primary Examiner*—Carl D. Friedman
*Assistant Examiner*—Kien T. Nguyen
*Attorney, Agent, or Firm*—Oldham & Oldham Co.

[57] ABSTRACT

In a stressing anchorage for prestressing elements (2) in part of a structure, at least one part of an anchor head (4) consists of a mortar-like mass in the area in which bores (3) are disposed to accept frustoconical wedges (8). The frustoconical wedges (8) are made of steel. Since the mortar-like mass on which the frustoconical wedges are supported is more ductile, i.e., more workable than the wedges (8), the distribution of load from the wedges (8) to the anchor head (4) takes place in such a fashion that marked peaks of the load are considerably reduced.

11 Claims, 6 Drawing Sheets

STRESSING ANCHORAGE FOR PRESTRESSING ELEMENTS IN A PART OF A STRUCTURE

TECHNICAL FIELD

The present invention relates to a stressing anchorage for prestressing elements in a part of a structure.

By the term stressing anchorage, dead end anchorages are also to be understood in the following.

A stressing anchorage of this kind for prestressing elements usually comprises a support device in the form of a bearing plate with trumpet and an anchor head, which is designed normally as a cylinder-shaped body of high quality steel. The anchor head has one or more continuous bores, running essentially parallel to the longitudinal axis of the head, through which are led the ends of the prestressing elements of a stressing anchorage. One of the two faces of the anchor head usually lies on one bearing plate. The said continuous bore or continuous bores, respectively, have conical extensions in the area of the other, second face turned away from the bearing plate, which extensions open toward the second face. Each of the conical extensions is intended to accept a frustoconical clamp, which serves to hold one each of the penetrating parts of the prestressing element in the form of a strand of the prestressing element, following stressing of the prestressing element.

BACKGROUND OF THE INVENTION

The production of the anchor heads in the prior art type of construction of high quality steel is materially expensive, and in addition very time consuming in the processing. Moreover it has been observed that the load distribution is uneven in the area of transition from the wedge to the conical part of the bore of the anchor head. This has to do with the fact that the conical form of the bipartite or tripartite clamp, whose parts have moreover longitudinal slots, cannot be produced, with respect to the conical part of the bore of the anchor head, in such a way that the fitting surfaces between the wedge and the conical part of the bore of the anchor head correspond exactly in the stressed state of the prestressing element. This is due to the fact that the wedge is pulled into the conical part of the bore of the anchor head by some millimeters during wedging of the prestressing element, achieving clamping of the prestressing element.

A clear load peak arises at the end of smaller diameter of the frustoconical wedge located on the interior of the anchor head. As could be proven in tests, a break in the prestressing element strand occurs practically only at this place.

SUMMARY OF THE INVENTION

The object of the invention consists in creating a stressing anchorage of such a quality that a more even load distribution is achieved in the area of the wedge to the prestressing element strand, and with which in addition a lighter and more cheaply produced anchor head can be used.

In such a stressing anchorage in stressed state of the prestressing element, the conoidal surfaces of the frustoconical wedge lie better on the cone-shaped surface of the anchor head formed by the mortar-like hardened mass. The mortar-like, hardened mass is more ductile, i.e. more workable than the steel of which the frustoconical wedges are made, and consequently adapts to the contour of the frustoconical wedges during the stressing process. Achieved in this way is a more even load distribution from the wedge to the clamped part of the prestressing element strand. The aforementioned clear load peak in the area of the smaller diameter of the frustoconical wedge is considerably reduced whereby protection is increased against the breaking load of the prestressing element.

An advantageous design of the invention consists in that the conical extension of the bore of the anchor head, which serves to accept the frustoconical clamp, has a second extension in its end area of greater diameter. Thus in this end area the end of the wedge does not come into contact with the mortar-like mass of the anchor head. This end area of the bore of the anchor head is thereby protected in the stressing process and in after-tensioning, during which the wedge is pulled out of the bore of the anchor head by a certain amount. Damage to the end area of the conical extension of the bore of the anchor head can thus be avoided.

In order to be able to adapt the distribution of load, conveyed from the frustoconical wedges to the anchor head when the prestressing elements are stressed, to the prevailing conditions and optimize it, it is advantageous to change slightly the cone angle of the conical extension of the bore of the anchor head with respect to the cone angle of the frustoconical clamp. Here it has been shown that with static load it is advantageous to shift the main load more toward the rear part of the clamp, i.e. the area of greater diameter of the frustum. This is achieved in that the cone angle of the conical extension of the bore in the anchor head is smaller than that of the frustoconical clamp. With dynamic loads the main load should be borne rather by the forward part of the clamp, i.e. in the area of a smaller diameter of the frustum. This can be achieved in that the cone angle of the conical extension of the bore of the anchor head is slightly larger than that of the frustoconical clamp. A further possibility exists in that only the rear part of the conical extension has a cone angle deviating slightly from the cone angle of the frustoconical wedge whereby, for example, the main load is distributed on two areas of the frustoconical clamp.

In an advantageous embodiment of the invention the anchor head can be constructed as a composite anchor head. Here the core of the anchor head, composed of the mortar-like hardened mass, is surrounded by a metallic casing, which is designed preferably as a ring. To hold the core in the ring in the direction of load, the inner surface area of the ring is conically shaped. The core of mortar-like mass is poured directly into the metallic casing. The metallic casing must be roughly machined on its inner surface. The pouring of the mortar-like mass and the hardening in the metallic casing results in an optimal fit between the core and the casing. This anchor head has a considerably reduced weight, compared to the prior art, all-steel construction. Fabrication is easier and less expensive too than for all-steel anchor heads.

A further advantageous embodiment of the invention consists in extending the inner surface of the ring, which surrounds the core as a casing, conically from both outer areas toward the middle area, and pouring the mortar-like mass as the core into this internal space of the ring. The connection between the ring and the core consisting of mortar-like mass thus becomes optimal.

A further advantageous embodiment of the invention consists in creating an anchorage which is concreted directly into the part of the structure to be prestressed. The bearing plate, consisting of a steel casing surrounding a ring of mortar-like, hardened mass, is concreted into the part of the structure, using high-strength concrete. Inserted into the ring, which consists of mortar-like mass and has a cone-shaped interior opening, is a core also of mortar-like, hardened mass. Contained in this ring are the bores which serve to receive the wedges. By concreting the bearing plate into the part of the structure to be prestresssed, the introduction of forces from the stressing anchorage to the corresponding part of the structure of high-strength concrete becomes optimal. In addition, fabrication of this stressing anchorage is simple and inexpensive.

BRIEF DESCRIPTION OF THE DRAWINGS

The invention will be explained more closely in the following, by way of example, with the aid of drawings in which.

DETAILED DESCRIPTION OF THE PREFERRED EMBODIMENT

Figure 1:
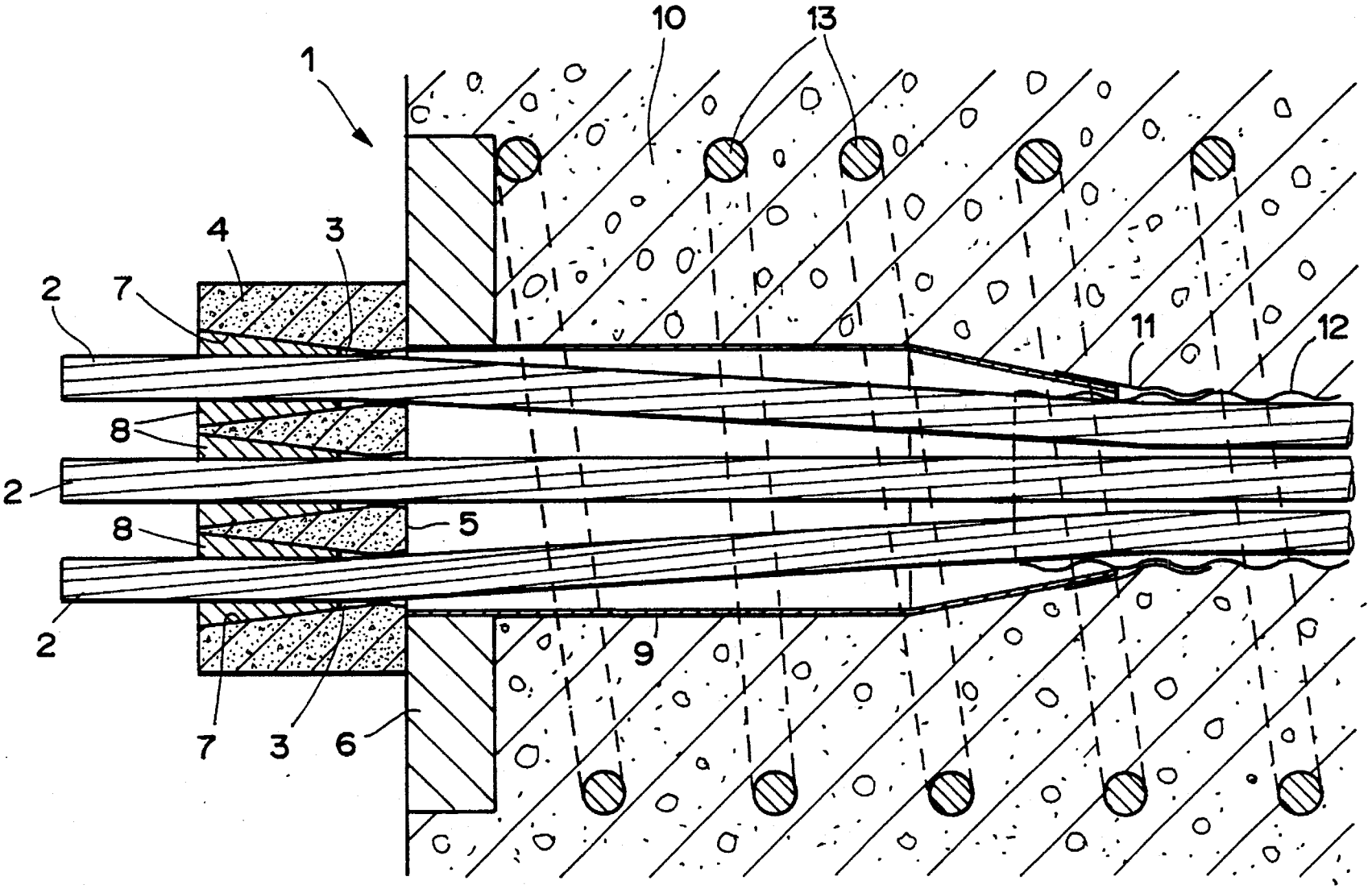
FIG. 1 is a section of a stressing anchorage with bearing plate and anchor head.

In the stressing anchorage 1 according to FIG. 1, each end of a prestressing element 2, formed as strand, is led through one of the bores 3 of an anchor head 4. Anchor head 4 lies with one face 5 on a bearing plate 6. Each bore 3 of anchor head 4 has a conical extension 7 toward the second face which is turned away from bearing plate 6. A frustoconical wedge 8 is placed in this conical extension 7 of bore 3 of anchor head 4. Frustoconical wedge 8, which is bipartite or tripartite, and which has moreover longitudinal slots, holds the end of prestressing element 2, formed of strands, in the prestressed position. Wedge 8 is pulled via prestressing element 2 into bore 3; the conical extension 7 of bore 3 presses wedge 8 on prestressing strand 2, by means of which prestressing element 2 is held.

In the case presented in FIG. 1, anchor head 4 consists of a mortar-like mass, which is hardened. Since this mortar-like mass is more ductile, i.e. more workable than the steel of the frustoconical wedge 8, the surface of extension 7 of this anchor head 4 adapts to the frustoconical surface of wedge 8. The surface of extension 7 which accepts the frustoconical wedge 8 is impregnated, sealed or coated.

The mortar-like, hardening mass can be, for example, a concrete, which has a firmness of at least 60 N/mm2 after hardening.

Bearing plate 6 is provided with a trumpet 9, which is made of sheet metal or high-strength PE, and which is concreted as a unit into a part of the structure 10. Trumpet 9, with its inner part 11, runs into a jacket tube 12, which is fabricated of steel or high-strength PE in the form of a corrugated pipe, in which the prestressing elements 2 are placed over the whole length of the part of the structure 10. A spiral 13 of reinforced steel is mounted on bearing plate 6, through which spiral the tension forces, arising from prestressing elements 2, can be better transferred from bearing plate 6 to the part of the structure of concrete.

Figure 2:
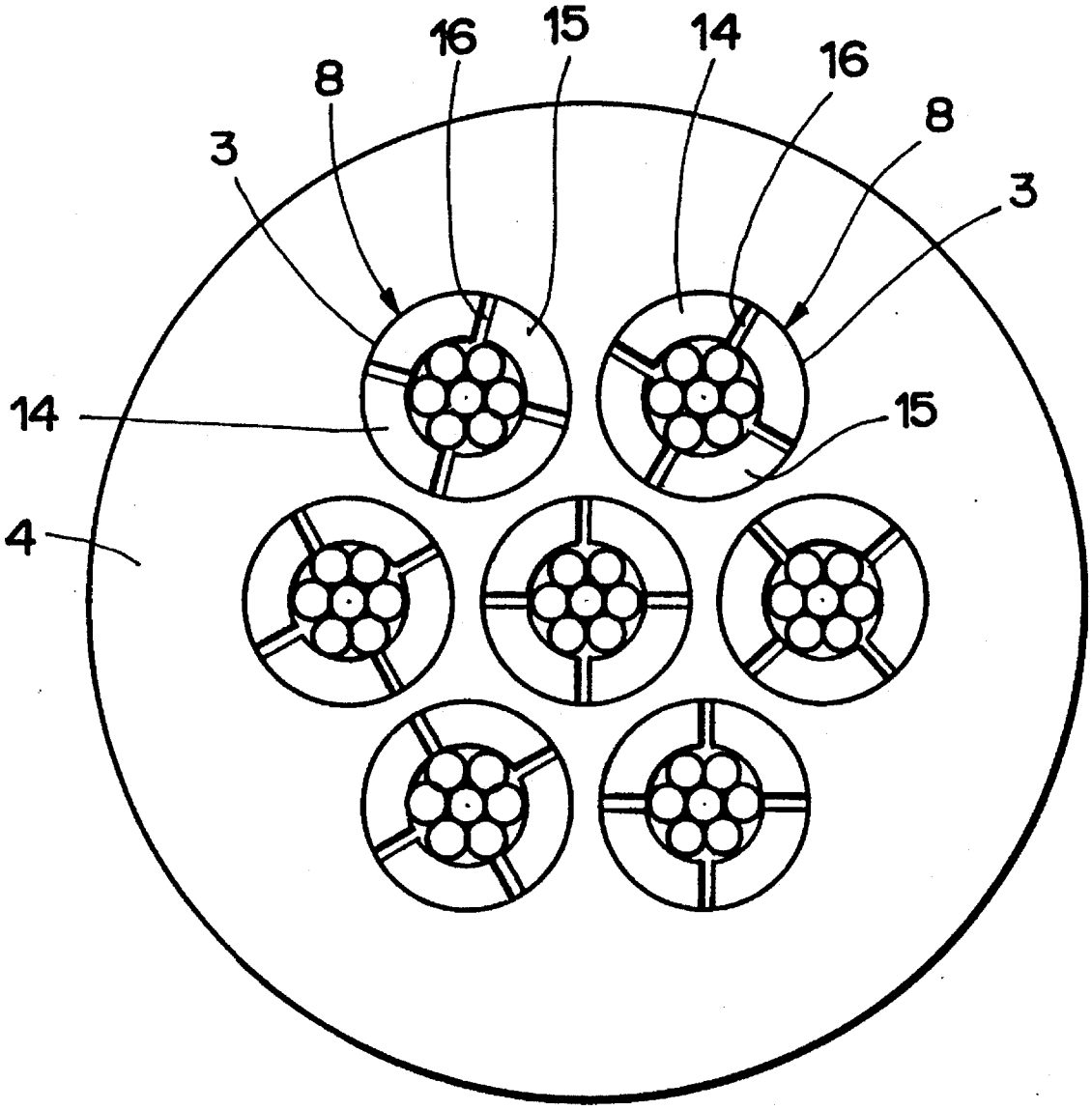
FIG. 2 is a top plan view of an anchor head according to FIG. 1.

FIG. 2 shows a view of anchor head 4 according to FIG. 1. Disposed distributed over anchor head 4 are several bores 3 to receive and hold prestressing elements 2 by means of frustoconical wedges 8. Here it can be seen that the frustoconical wedges 8 consist of two half shells 14 and 15, and have in addition longitudinal slots 16.

Figure 3:
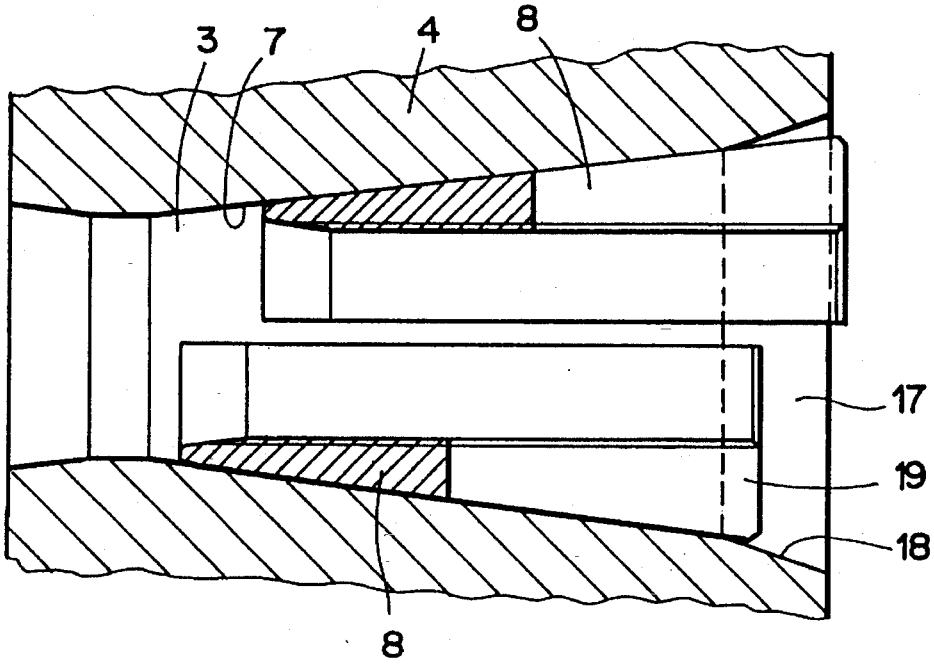
FIG. 3 is a section through a wedge in the anchor head, showing the upper half of the wedge before setting, the lower half of the wedge after stressing.

In the upper half of the section according to FIG. 3, shown through a bore 3 of anchor head 4, is the position of wedge 8 before setting, and in the lower half the position of wedge 8 is shown after stressing of the prestressing elements (not depicted). Conical extension 7, essentially corresponding to the frustoconical form of wedge 8, has in its end area 17 a second conical extension 18, whose angle of opening is larger than that of conical extension 7. In inserting wedge 8 into conical extension 7, the surface of wedge 8 in end area 17 does not come into contact with the mortar-like mass of anchor head 4. The depth of second conical extension 18 is selected in such a way that wedge 8 even after stressing, as shown in the lower half of FIG. 3, still has an outside end area 19 which still lies in the area of the second conical extension so that wedge 8 in this end area 19 does not come into contact with the mortar-like mass of anchor head 4. Achieved thereby is that the edge of the bore in end area 17 remains undamaged during repeated stressing procedures of the prestressing elements during which wedge 8 is pulled at least partially out of bore 3 of anchor head 4.

Figure 4:
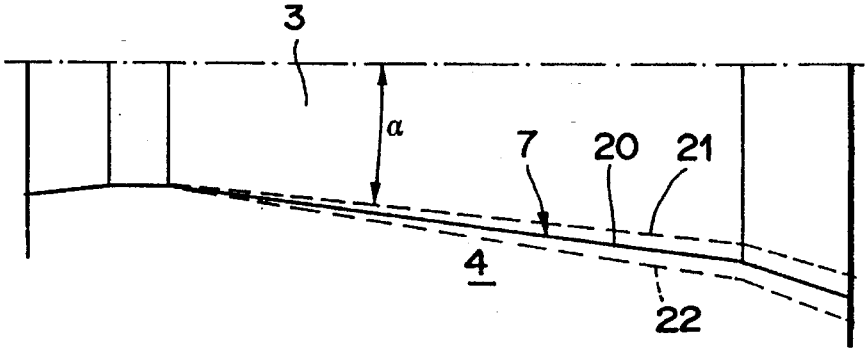
FIG. 4 is a diagrammatic section of the design of the conical extension of the bore of the anchor head.

FIG. 4 shows a section through the conical extension 7 of bore 3 of anchor head 4. The solid line 20 shows the conical extension which essentially corresponds to the frustoconical form of wedge 8. Depending upon the type of load on the prestressing elements and consequently on the frustoconical wedge 8, cone angle $\alpha$ is adapted in the production of anchor head 4 with bores 3. Achieved with a smaller cone angle $\alpha$, indicated by broken line 21, is that the main load is transferred more to the rear, i.e. in the fatter area of the wedge to the clamped strand part of prestressing element 2. This is desired in particular when the prestressing elements and consequently the wedge are subjected to a static load.

Achieved with a larger cone angle $\alpha$, indicated by broken line 22, is that the main stress of the load, affecting the prestressing elements, is transferred more toward the frontal area of wedge 8 to the clamped strand part of prestressing element 2. This is especially desired when a dynamic load acts upon the prestressing elements and consequently upon the anchor head 4.

The changes in the cone angle $\alpha$ with respect to the frustoconical form of the wedge lie within an range of $\pm 1$ degree.

Figure 5:
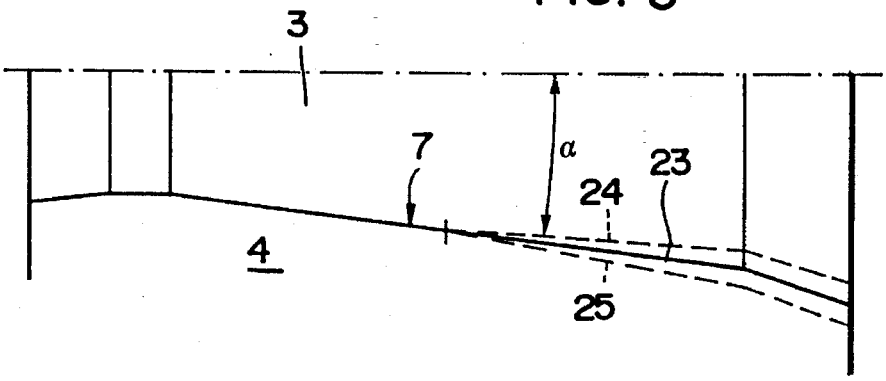
FIG. 5 is a diagrammatic section of another design of the conical extension of the bore of the anchor head.

Apparent from FIG. 5 is how the main load, having an effect from the frustoconical wedge 8 upon the clamped strand part of prestressing element 2, can be transferred distributed differently. Presented here by a solid line 23, as in FIG. 4, is the conical extension of bore 3 of anchor head 4 which corresponds to the frustoconical form of wedge 8. The change in the cone angle of conical extension 7 occurs outwardly starting from the middle of conical extension 7. With a reduction of the cone angle represented by the broken line 24, the main load is transferred from wedge 8 in the area of greater diameter to the clamped strand part of prestressing element 2, while a smaller part of the load is conveyed from wedge 8 in the area of smaller diameter to the clamped strand part of prestressing element 2.

With an enlargement of cone angle α, represented by broken line 25, transfer of the main load takes place from wedge 8 to the clamped strand part of prestressing element 2 in the area of the wedge having a smaller diameter. For this embodiment too, the range of change of cone angle α lies within ±1 degree.

Figure 6:
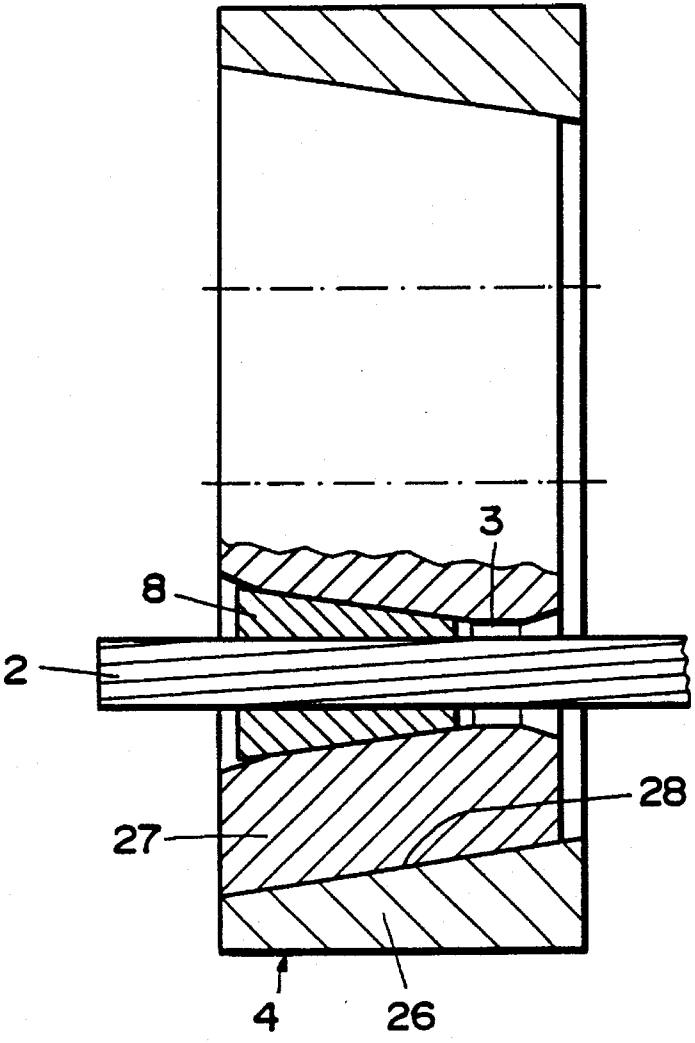
FIG. 6 is a section through an anchor head with metallic encasing, which has a conical interior form.

Seen in FIG. 6 is another embodiment of anchor head 4 according to FIG. 1. A metallic casing designed as a ring surrounds a core 27. Core 27 consists of a mortar-like, hardened mass, for example special mortar on cement base, and has, as in FIG. 1, bores 3, which are provided with a conical extension 7 to receive frustoconical wedges 8 and thus to hold prestressing elements 2. These bores 3 can be designed according to an embodiment as shown in FIGS. 3 to 5 and described above. The inner surface 28 of metallic casing 26 is conically shaped, the cone narrowing in the direction of pull of prestressing elements 2. The mortar-like mass is poured directly as core 27 into the metallic casing 26, which has the advantage that the inner surface 28 of metallic casing 26 has to be machined and that an optimal fit of core 27 in metallic casing 26 is achieved.

Pouring of the mortar-like mass into the metallic casing 26 takes place from the narrower side of the cone of the metallic casing outward. In this way the surface of core 27, which is the visible surface in the assembled state, is flat and even with the face of the metallic casing while the inner surface of core 27 is set back from the supporting surface of the metallic casing 26 so that anchor head 4 lies only with the metallic casing on bearing plate 6.

Figure 7:
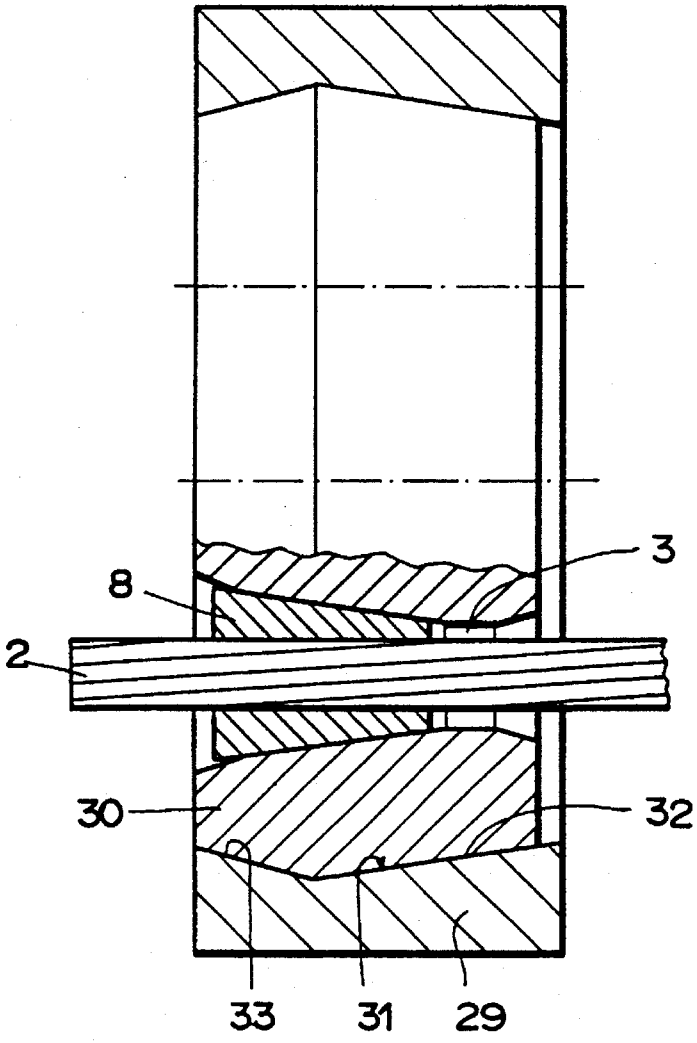
FIG. 7 is a section through an anchor head with a metallic encasing, which has a biconical interior form.

Another embodiment of anchor head 4 can be taken from FIG. 7. The anchor head 4 presented in FIG. 7 has essentially the same construction as that according to FIG. 6. Here too a metallic casing 29 in the form of a ring surrounds a core 30, which consists of a mortar-like, hardened mass and which has bores 3 for receiving prestressing elements 2 and frustoconical wedges 8.

In contrast to the anchor head presented in FIG. 6, the anchor head according to FIG. 7 has a metallic casing 29 whose inner surface 31 has two conical shaped areas 32 and 33, each of which extends conically from one face toward the central area. The mortar-like mass, which forms the core 30, is poured into the metallic casing 29 in a way identical to that described for the anchor head presented in FIG. 6. Through this design of the metallic casing 29, core 30 of mortar-like mass is held optimally in metallic casing 29. Bore 3 can be made in a way such as that presented in FIGS. 3 to 5.

Figure 8:
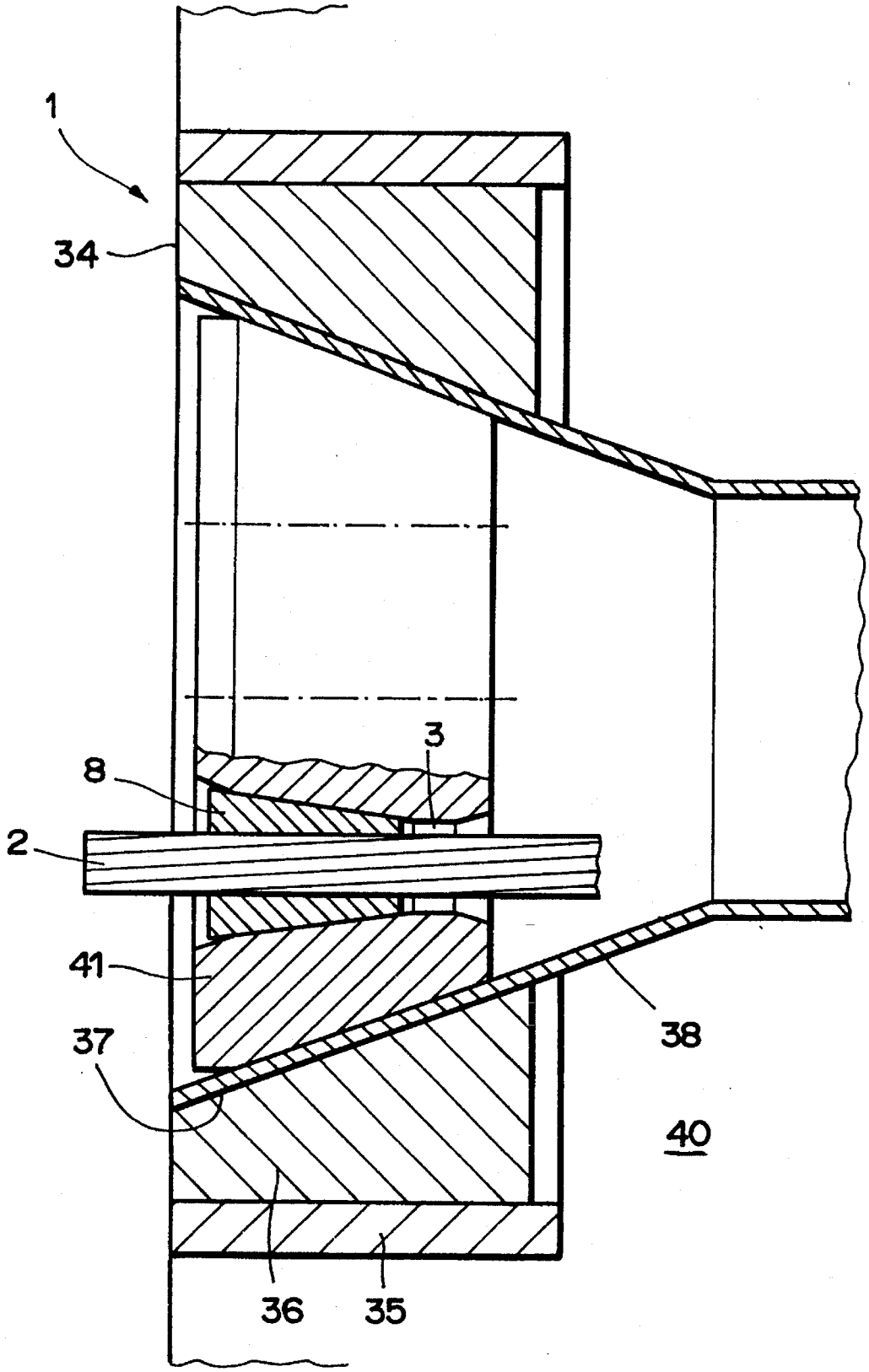
FIG. 8 is a section through a bearing plate, which is concreted into the part of the structure, with an insert and an inserted core of mortar-like, hardened mass.

A further embodiment of a stressing anchorage 1 is presented in FIG. 8. Here the bearing plate 34 consists of a metallic casing 35, which has a ring-shaped design, and into which an insert 36 composed of mortar-like mass is inserted. This insert 36 has a cone-shaped inner surface 37 opening outwardly. Inserted in the cone-shaped inner surface 37 is a trumpet-shaped transition piece 38 comprised of high-strength PE which abuts the cone-shaped inner surface 37 of insert 36. Bearing plate 34 is concreted into part of the structure 40. Inserted into the area of the trumpet-shaped transition piece 38, which abuts cone-shaped inner surface 37 of insert 36, is a core 41 which is composed entirely of mortar-like mass, for example concrete with a firmness of at least 60 N/mm$^2$. Here insert 36 acts as a load distributing and cushioning element between the abutting surfaces of the core 41 and the insert 36. This core 41 is provided with bores 3 which can be designed in one of the ways as described under FIGS. 3 to 5. Inserted into each of the bores is a frustoconical wedge 8, which serves to hold the prestressing element. By means of this arrangement, the connection between the stressing anchorage and the part of the structure to be prestressed becomes optimal, especially with respect to the introduction of forces in the concrete. Production of this stressing anchorage is reasonable in cost due to the simple design.

Figure 9:
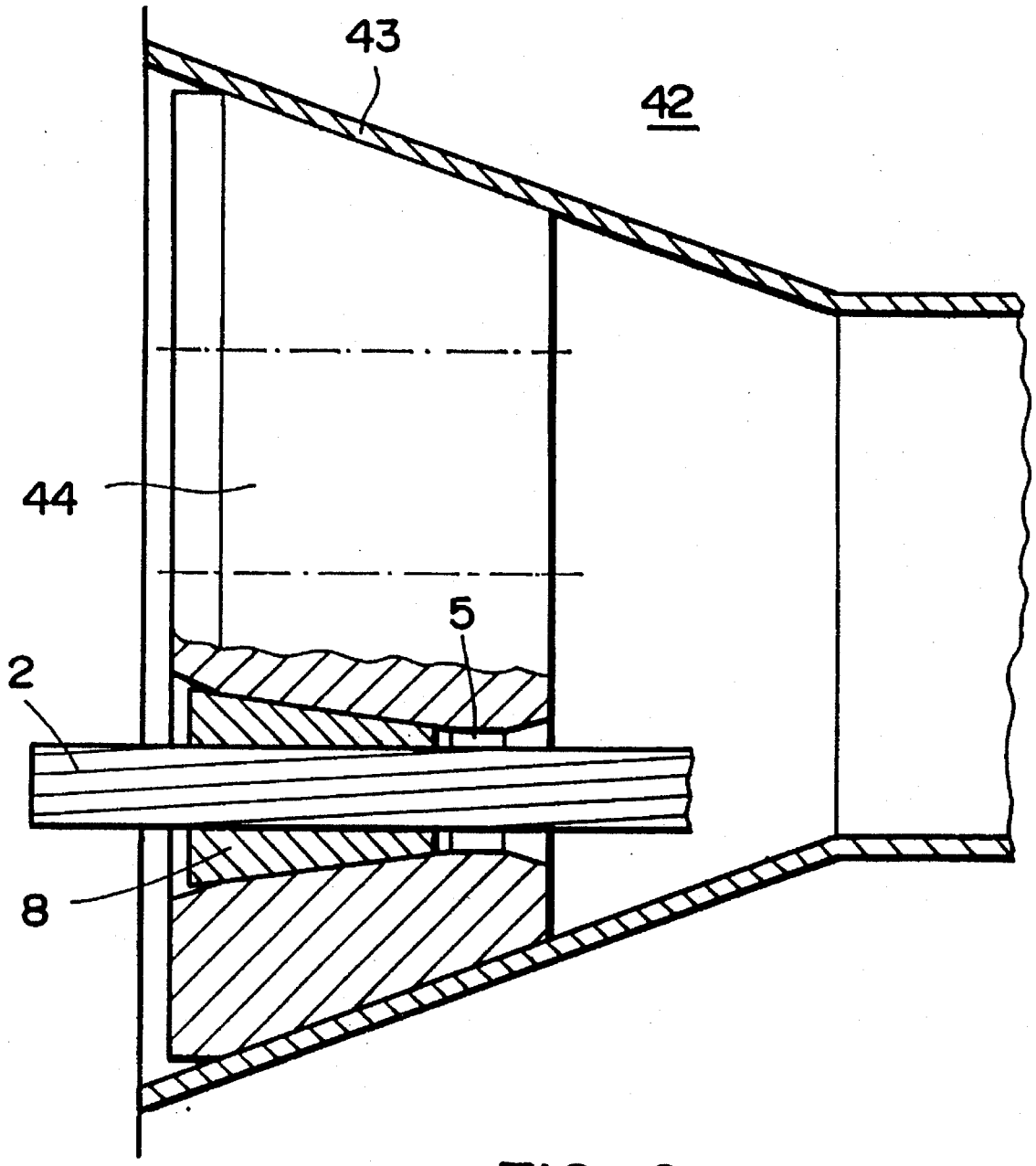
FIG. 9 is a section through an anchor head, inserted into a cone-shaped insert concreted into the part of the structure.

A further embodiment of a stressing anchorage, presented in FIG. 9, has an insert 43 concreted into the part of the structure 42, which in this case is composed of high-strength concrete. Put into this cone-shaped insert 43 is an anchor head 44 which has a frustoconical form corresponding to the cone shape of insert 43 and which is composed of a mortar-like, hardened mass. Bores 5, which are disposed in anchor head 44 and which serve to receive the frustoconical wedges 8 for holding the prestressing elements 2, are designed in a way described according to FIGS. 3 to 5.

Used as an aid to concrete in the cone-shaped insert 43 is a body which has essentially an outer form corresponding to the inner form of the cone-shaped insert. This is done, on the one hand, for reasons of stability so that the thin-walled cone-shaped insert is not compressed, and, on the other hand, to fix the insert in an aligned position with respect to the prestressing elements 2.

What is claimed is:

1. A stressing anchorage for prestressing elements in part of a structure, said stressing anchorage comprising:

a support device having a trumpet;

an anchor head supported on the support device, the anchor head being provided with at least one continuous bore running parallel to the longitudinal axis of the anchor head; and a frustoconical wedge;

wherein the bore has a conical extension tapering toward an outer face of the anchor head which is disposed away from the support device to accept the frustoconical wedge to hold one of the prestressing elements;

wherein at least a part of the anchor head, in which is disposed the bore to accept the frustoconical wedge, consists of a mortar-like, hardened mass, while the frustoconical wedge is made of steel, whose frustoconical surface in the stressed state of the prestressing element abuts the surface of the conical extension of the bore in the mortar-like mass.

2. The stressing anchorage according to claim 1, wherein the conical extension to accept the frustoconical wedge has in its end area of larger diameter a second conical extension, whose opening angle is larger than that of the conical extension, whereby there is an empty space between the end of the wedge having the larger diameter, which extends the area of the second conical extension, and the second conical extension.

3. The stressing anchorage according to claim 1, wherein to accept the frustoconical wedge the conical extension has a cone angle which deviates from the angle of the frustum of the wedge and is slightly larger or smaller.

4. The stressing anchorage according to claim 1, wherein a partial area of the conical extension to accept the frustoconical wedge has a cone angle which deviates from the angle of the frustum of the wedge and is slightly larger or smaller.

5. The stressing anchorage according to claim 1, wherein the surface of the conical extension to accept the frustoconical wedge is impregnated, sealed or coated.

6. The stressing anchorage according to claim 1, wherein the anchor head is composed entirely of a mortar-like, hardened mass.

7. The stressing anchorage according to claim 1, wherein the anchor head further consists of a metallic casing, having an inner surface area of conical shape which surrounds a core consisting of a mortar-like, hardened mass.

8. The stressing anchorage according to claim 1, wherein the anchor head further consists of a metallic casing, having an inner surface area with two conical areas extending from two outer areas toward a central area, and wherein the mortar-like mass is poured into the inner space of the casing.

9. The stressing anchorage according to claim 1, further comprising a bearing plate composed of an insert consisting of mortar-like mass surrounded by a metallic casing and having a conical, continuous interior opening into which a core is inserted consisting of a mortar-like, hardened mass and having a surface corresponding to the conical interior opening of the insert, and which serves to accept the wedges.

10. The stressing anchorage according to claim 1, wherein the anchor head, which consists entirely of a mortar-like hardened mass, has a frustoconical form, which is inserted into a conical insert concreted into the part of said anchorage and is supported with its frustoconical surface area on the conical inner form of the insert.

11. The stressing anchorage according to claim 1, wherein the mortar-like mass has a firmness after hardening of at least 60 $N/mm^2$.

* * * * *